US010871063B2

(12) United States Patent
Nanayakkara

(10) Patent No.: US 10,871,063 B2
(45) Date of Patent: Dec. 22, 2020

(54) TOOLFACE CONTROL WITH PULSE WIDTH MODULATION

(71) Applicant: Halliburton Energy Services, Inc., Houston, TX (US)

(72) Inventor: Ravi P. Nanayakkara, Kingwood, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 74 days.

(21) Appl. No.: 15/531,472

(22) PCT Filed: Dec. 29, 2014

(86) PCT No.: PCT/US2014/072551
§ 371 (c)(1),
(2) Date: May 30, 2017

(87) PCT Pub. No.: WO2016/108822
PCT Pub. Date: Jul. 7, 2016

(65) Prior Publication Data

US 2017/0260841 A1 Sep. 14, 2017

(51) Int. Cl.

| | |
|---|---|
| ***E21B 44/00*** | (2006.01) |
| ***E21B 47/024*** | (2006.01) |
| ***E21B 47/18*** | (2012.01) |
| ***E21B 4/02*** | (2006.01) |
| ***E21B 7/04*** | (2006.01) |
| ***E21B 21/10*** | (2006.01) |
| ***E21B 47/20*** | (2012.01) |

(52) U.S. Cl.
CPC ..... *E21B 44/005* (2013.01); *E21B 4/02* (2013.01); *E21B 7/04* (2013.01); *E21B 21/10* (2013.01); *E21B 47/024* (2013.01); *E21B 47/20* (2020.05)

(58) Field of Classification Search
CPC .... E21B 44/005; E21B 47/182; E21B 47/024; E21B 21/10; E21B 7/04; E21B 4/02
See application file for complete search history.

(56) References Cited

U.S. PATENT DOCUMENTS

| | | | |
|---|---|---|---|
| 2,879,032 | A | 3/1959 | Whittle |
| 3,802,515 | A | 4/1974 | Flamand et al. |
| 4,393,651 | A | 7/1983 | Peck et al. |

(Continued)

FOREIGN PATENT DOCUMENTS

| | | | | |
|---|---|---|---|---|
| WO | WO2013187885 | * | 12/2013 | |
| WO | WO2013187885 A1 | * | 12/2013 | ..... E21B 7/08 |
| WO | 2014/098900 | | 6/2014 | |

OTHER PUBLICATIONS

International Search Report and Written Opinion for PCT Patent Application No. PCT/US2014/072551, dated Sep. 3, 2015; 11 pages.

*Primary Examiner* — David J Bagnell
*Assistant Examiner* — Jonathan Malikasim
(74) *Attorney, Agent, or Firm* — Baker Botts L.L.P.

(57) ABSTRACT

In accordance with some embodiments of the present disclosure, systems and methods for a toolface control system is disclosed. The system includes, a rotating drill string of a drilling tool, an assembly located within the rotating drill string representing a current toolface of the drilling tool, and a controller configured to use pulse width modulation to adjust a rotational speed of the assembly to maintain the current toolface at a desired toolface.

16 Claims, 3 Drawing Sheets

(56) References Cited

U.S. PATENT DOCUMENTS 5,265,682 A * 11/1993 Russell ..... E21B 4/02 175/45
5,685,379 A * 11/1997 Barr ..... E21B 7/068 175/61
5,738,178 A * 4/1998 Williams ..... E21B 4/02 175/61
6,092,610 A 7/2000 Kosmala et al.
6,202,762 B1 3/2001 Fehr et al.
6,209,309 B1 4/2001 McArthur
6,568,485 B2 5/2003 Falgout, Sr.
6,898,150 B2 5/2005 Hahn et al.
7,086,486 B2 8/2006 Ravensbergen et al.
7,484,566 B2 2/2009 Tips et al.
7,523,792 B2 4/2009 El-Rayes et al.
7,564,741 B2 7/2009 Pratt et al.
7,757,781 B2 * 7/2010 Hay ..... E21B 4/02 175/107
7,779,933 B2 8/2010 Sihler et al.
7,913,772 B2 3/2011 Sherrill et al.
8,033,328 B2 10/2011 Hall et al.
8,069,926 B2 12/2011 Eddison et al.
8,092,147 B2 1/2012 Draeger et al.
8,146,679 B2 4/2012 Downton
8,167,051 B2 5/2012 Eddison et al.
8,297,375 B2 10/2012 Hall et al.
8,350,715 B2 * 1/2013 Shearer ..... E21B 47/18 340/853.1
8,550,166 B2 10/2013 Xu et al.
2002/0002817 A1 1/2002 Keller
2005/0139393 A1 6/2005 Maurer et al.
2005/0211471 A1 9/2005 Zupanick
2006/0191682 A1 * 8/2006 Storm ..... E21B 47/011 166/250.01
2010/0085676 A1 4/2010 Wilfert
2010/0212963 A1 8/2010 Gopalan et al.
2011/0036631 A1 2/2011 Prill et al.
2011/0108327 A1 5/2011 Farley et al.
2014/0291023 A1 10/2014 Edbury et al.
2014/0332270 A1 11/2014 Odell, II et al.

* cited by examiner

TOOLFACE CONTROL WITH PULSE WIDTH MODULATION

RELATED APPLICATIONS

This application is a U.S. National Stage Application of International Application No. PCT/US2014/072551 filed Dec. 29, 2014, which designates the United States, and which is incorporated herein by reference in its entirety.

TECHNICAL FIELD

The present disclosure relates generally to downhole drilling tools and, more particularly, to an advanced toolface control system for rotary steerable drilling tools using pulse width modulation.

BACKGROUND

Various types of downhole drilling tools including, but not limited to, rotary drill bits, reamers, core bits, and other downhole tools have been used to form wellbores in associated downhole formations. Examples of such rotary drill bits include, but are not limited to, fixed cutter drill bits, drag bits, polycrystalline diamond compact (PDC) drill bits, matrix drill bits, roller cone drill bits, rotary cone drill bits and rock bits associated with forming oil and gas wells extending through one or more downhole formations.

Conventional wellbore drilling in a controlled direction requires multiple mechanisms to steer drilling direction. Bottom hole assemblies have been used and have included the drill bit, stabilizers, drill collars, heavy weight pipe, and a positive displacement motor (mud motor) having a bent housing. The bottom hole assembly is connected to a drill string or drill pipe extending to the surface. The assembly steers by sliding (not rotating) the assembly with the bend in the bent housing in a specific direction to cause a change in the wellbore direction. The assembly and drill string are rotated to drill straight.

Other conventional wellbore drilling systems use rotary steerable arrangements that use deflection to point-the-bit. They may provide a bottom hole assembly that may have a flexible shaft in the middle of the tool with an internal cam to bias the tool to point-the-bit.

BRIEF DESCRIPTION OF THE DRAWINGS

For a more complete understanding of the present disclosure and its features and advantages, reference is now made to the following description, taken in conjunction with the accompanying drawings, in which.

DETAILED DESCRIPTION

A rotary steerable drilling system may be used with directional drilling systems including steering a drill bit to drill a non-vertical wellbore. Directional drilling systems, such as a rotary steerable drilling system, may include systems and/or components to measure, monitor, and/or control the toolface of the drill bit. The term "toolface" may refer to the orientation of a reference direction on the drill string as compared to a fixed reference. The "toolface angle" may refer to the angle, measured in a plane perpendicular to the drill string axis, between the reference direction and the fixed reference, and is usually defined between +180 degrees and −180 degrees. The toolface angle may be the amount the drill string has rotated away from the fixed reference and may also be referred to as the magnetic toolface. For a more-deviated wellbore, the top of the wellbore may be the fixed reference. In such cases, the toolface angle may be referred to as the gravity toolface, or high side toolface.

During drilling operations, disturbances that may cause tool rotation anomalies such as interaction with cuttings, vibrations, bit walk, bit whirl, and bit bounce may also cause the toolface to deviate from a desired angle. The toolface may affect the smoothness of the wellbore as well as the time and cost to drill the wellbore. Therefore, it may be advantageous to implement a control system as part of a rotary steerable drilling system that controls the toolface, thereby reducing drilling costs and speed. Accordingly, control systems and methods may be designed in accordance with the teachings of the present disclosure and may have different designs, configurations, and/or parameters according to the particular application. Embodiments of the present disclosure and its advantages are best understood by referring to FIGS. 1 through 5, where like numbers are used to indicate like and corresponding parts.

Figure 1A:
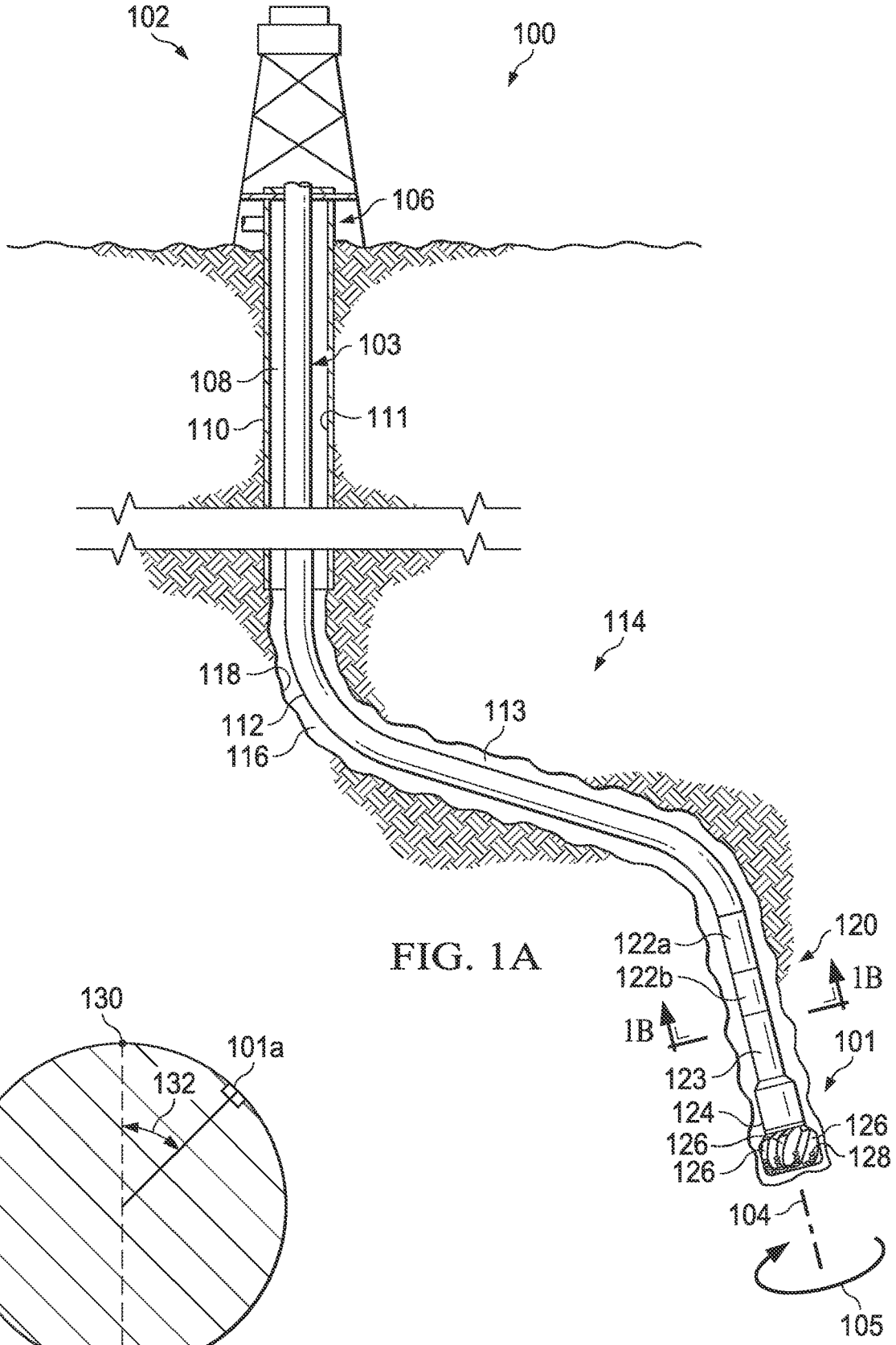
FIG. 1A illustrates an elevation view of an example embodiment of a drilling system.

FIG. 1A illustrates an elevation view of an example embodiment of a drilling system. Drilling system 100 may include well surface or well site 106. Various types of drilling equipment such as a rotary table, drilling fluid pumps and drilling fluid tanks (not expressly shown) may be located at well site 106. For example, well site 106 may include drilling rig 102 that has various characteristics and features associated with a "land drilling rig." However, downhole drilling tools incorporating teachings of the present disclosure may be satisfactorily used with drilling equipment located on offshore platforms, drill ships, semi-submersibles and drilling barges (not expressly shown).

Drilling system 100 may also include drill string 103 associated with drill bit 101 that may be used to form a wide variety of wellbores or bore holes such as generally diagonal or directional wellbore 114. The term "directional drilling" may be used to describe drilling a wellbore or portions of a wellbore that extend at a desired angle or angles relative to vertical. The desired angles may be greater than normal variations associated with vertical wellbores. Directional drilling may be used to access multiple target reservoirs within a single wellbore 114 or reach a reservoir that may be inaccessible via a vertical wellbore. Rotary steerable drilling system 123 may be used to perform directional drilling. Rotary steerable drilling system 123 may use a point-the-bit method to cause the direction of drill bit 101 to vary relative to the housing of rotary steerable drilling system 123 by bending a shaft (e.g., inner shaft 208 shown in FIG. 2) running through rotary steerable drilling system 123.

Bottom hole assembly (BHA) 120 may include a wide variety of components configured to form wellbore 114. For example, components 122*a* and 122*b* of BHA 120 may include, but are not limited to, drill bits (e.g., drill bit 101), coring bits, drill collars, rotary steering tools (e.g., rotary steerable drilling system 123), directional drilling tools, downhole drilling motors, reamers, hole enlargers or stabilizers. The number and types of components 122 included in BHA 120 may depend on anticipated downhole drilling conditions and the type of wellbore that will be formed by drill string 103 and rotary drill bit 101. BHA 120 may also include various types of well logging tools (not expressly shown) and other downhole tools associated with directional drilling of a wellbore. Examples of logging tools and/or directional drilling tools may include, but are not limited to, acoustic, neutron, gamma ray, density, photoelectric, nuclear magnetic resonance, rotary steering tools and/or any other commercially available well tool. Further, BHA 120 may also include a rotary drive (not expressly shown) connected to components 122*a* and 122*b* and which rotates at least part of drill string 103 together with components 122*a* and 122*b*.

Wellbore 114 may be defined in part by casing string 110 that may extend from well surface 106 to a selected downhole location. Portions of wellbore 114, as shown in FIG. 1A, that do not include casing string 110 may be described as "open hole." Various types of drilling fluid may be pumped from well surface 106 downhole through drill string 103 to attached drill bit 101. "Uphole" may be used to refer to a portion of wellbore 114 that is closer to well surface 106 and "downhole" may be used to refer to a portion of wellbore 114 that is further from well surface 106 along the length of wellbore 114. The drilling fluids may be directed to flow from drill string 103 to respective nozzles passing through rotary drill bit 101. The drilling fluid may be circulated uphole to well surface 106 through annulus 108. In open hole embodiments, annulus 108 may be defined in part by outside diameter 112 of drill string 103 and inside diameter 118 of wellbore 114. In embodiments using casing string 110, annulus 108 may be defined by outside diameter 112 of drill string 103 and inside diameter 111 of casing string 110.

Drilling system 100 may also include rotary drill bit ("drill bit") 101. Drill bit 101 may include one or more blades 126 that may be disposed outwardly from exterior portions of rotary bit body 124 of drill bit 101. Blades 126 may be any suitable type of projections extending outwardly from rotary bit body 124. Drill bit 101 may rotate with respect to bit rotational axis 104 in a direction defined by directional arrow 105. Blades 126 may include one or more cutting elements 128 disposed outwardly from exterior portions of each blade 126. Blades 126 may also include one or more depth of cut controllers (not expressly shown) configured to control the depth of cut of cutting elements 128. Blades 126 may further include one or more gage pads (not expressly shown) disposed on blades 126. Drill bit 101 may be designed and formed in accordance with teachings of the present disclosure and may have many different designs, configurations, and/or dimensions according to the particular application of drill bit 101.

Figure 1B:
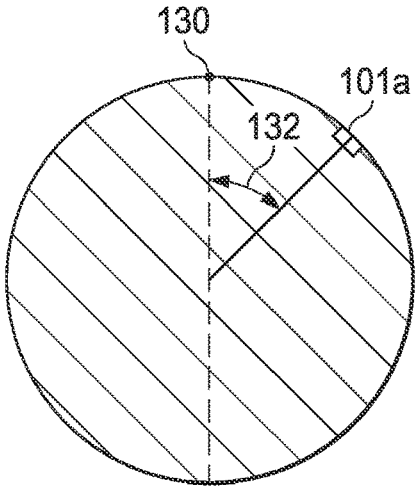
FIG. 1B illustrates a toolface angle for an example embodiment of a drilling system.
Figure 2:
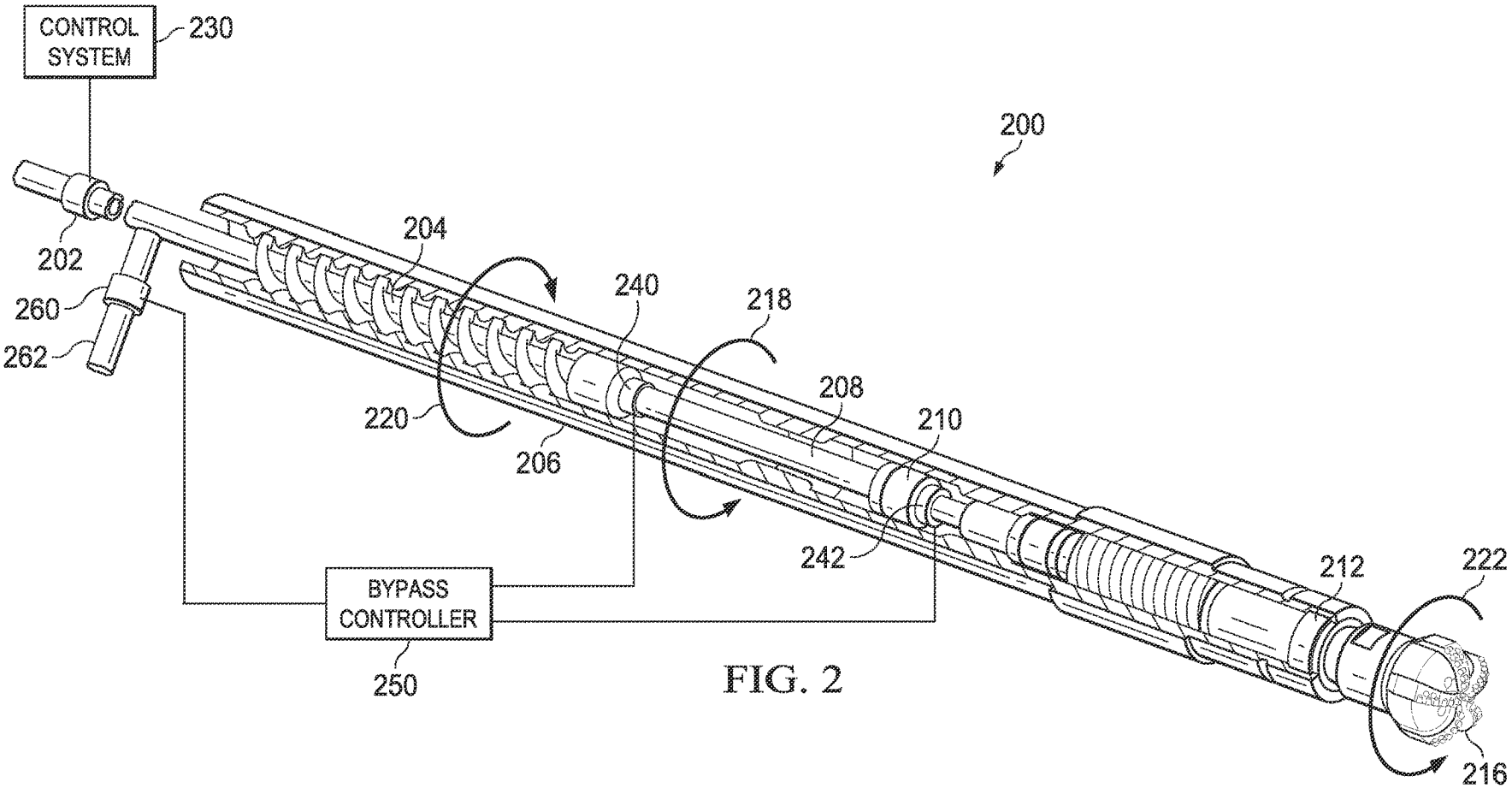
FIG. 2 illustrates a perspective view of a rotary steerable drilling system.

Drill bit 101 may be a component of rotary steerable drilling system 123, discussed in further detail in FIG. 2. Drill bit 101 may be steered by adjusting the toolface of drill bit 101 to control the direction of drill bit 101 to form generally directional wellbore 114. The toolface may be the angle, measured in a plane perpendicular to the drill string axis that is between a reference direction on the drill string and a fixed reference and may be any angle between +180 degrees and −180 degrees. For example, in FIG. 1A, the plane perpendicular to the drill string axis may be the plane shown in FIG. 1B. For a directional wellbore, the fixed reference may be the top of the wellbore, shown in FIG. 1B as point 130. The toolface may be the angle between the fixed reference and the reference direction, e.g., the tip of drill bit 101. In FIG. 1B, toolface angle 132 is the angle between point 130, e.g., the top of the wellbore, and the tip of drill bit 101*a*. In other embodiments, the fixed reference may be magnetic north, a line opposite to the direction of gravity, or any other suitable fixed reference point.

While performing a drilling operation, disturbances (e.g., vibrations, bit walk, bit bounce, the presence of formation cuttings, or any other cause of a tool rotation anomaly) may cause the toolface to deviate from the desired toolface input by a drilling operator, or a control system. Therefore, it may be advantageous to control the toolface by incorporating a control system that compensates for disturbances acting on drill bit 101 and the dynamics of rotary steerable drilling system 123 in order to maintain the desired toolface, as discussed in further detail below. The control system may be located in whole or in part downhole, as a component of rotary steerable drilling system 123, or at well surface 106 and may communicate control signals to rotary steerable drilling system 123 via drill string 103, through the drilling fluids flowing through drill string 103, or any other suitable method for communicating signals to and from downhole tools. Rotary steerable drilling system 123 including one or more control systems designed according to the present disclosure may improve the accuracy of steering drill bit 101 by accounting for and mitigating the effect of downhole vibrations on the toolface. A toolface that is closer to the desired toolface may also improve the quality of wellbore 114 by preventing drill bit 101 from deviating from the desired toolface throughout the drilling process. Additionally, rotary steerable drilling system 123 including a control system designed according to the present disclosure may improve tool life and drilling efficiency of drill bit 101 due to the ability to increase the speed of drilling and decrease the cost per foot of drilling.

FIG. 2 illustrates a perspective view of a rotary steerable drilling system. Rotary steerable drilling system 200 may include valve 202, turbine 204, housing 206, inner shaft 208, eccentric cam 210, thrust bearings 212, and drill bit 216. In some embodiments, housing 206 may rotate with a drill string, such as drill string 103 shown in FIG. 1A. For example, housing 206 may rotate in direction 218, which may in turn cause drill bit 216 to rotate and form the wellbore 114 shown in FIG. 1A. To maintain a desired toolface while housing 206 rotates, inner shaft 208 may rotate in the opposite direction of, and at the same speed as, the rotation of housing 206. For example, inner shaft 208 may rotate in direction 220 at or near the same speed housing 206 rotates in direction 218.

Valve 202 may be located uphole of the other components of rotary steerable drilling system 200. Valve 202 may be designed to govern the flow rate of drilling fluid into turbine 204. For example, the flow rate of drilling fluid that flows into turbine 204 may increase as valve 202 is opened. Valve 202 may be controlled by any suitable method. For example, an actuator (not expressly shown), or any other device may be used to open and close valve 202. In some embodiments, the actuator may be a motor configured to open and close valve 202. A current or voltage sent to the motor may change the amount that valve 202 is opened. Rotary steerable drilling system 200 may include any type of valve that may control the flow rate of drilling fluid into turbine 204, including those disclosed in more detail with respect to FIGS. 5A and 5B.

The flow of drilling fluid into turbine 204 may affect the rotational speed or angular velocity of turbine 204. The rotational speed of turbine 204 may be directly proportional to the flow rate of drilling fluid into turbine 204. For example, the rotational speed of turbine 204, ω, may be represented by $$\omega = c_1 \cdot Q - \frac{c_2 \cdot \tau}{Q}$$

where $c_1$ and $c_2$ are parameters of turbine 204, Q is the flow rate of the drilling fluid into turbine 204, and τ is the torque of turbine 204. Changing the flow rate of drilling fluid into turbine 204 may result in a change to the rotational speed of turbine 204, Δω, that may be represented by $$\Delta\omega = c_1 \cdot \Delta Q - \frac{c_2 \cdot \tau}{\Delta Q}$$

where ΔQ is the change in the flow rate of drilling fluid into turbine 204. Thus, controlling the flow rate of drilling fluid into turbine 204 may control the rotational speed of turbine 204.

The rotational speed of inner shaft 208 may be similarly affected by the flow rate of drilling fluid into turbine 204. Inner shaft 208 may be coupled to turbine 204 so that the rotational speed of inner shaft 208 may be determined by the rotational speed of turbine 204. Thus, controlling the flow rate of drilling fluid into turbine 204, may also affect the rotational speed of inner shaft 208, which may in turn affect the toolface at drill bit 216.

A set of planetary gears may couple housing 206, inner shaft 208, and thrust bearings 212. Inner shaft 208 may rotate at the same speed but in the opposite direction of housing 206 to maintain the toolface at drill bit 216 at the desired angle. The positioning of the planetary gears may contribute to maintaining the desired toolface at drill bit 216 between +180 and −180 degrees.

Eccentric cam 210 may be designed to bend rotary steerable drilling system 200 to point drill bit 216. Eccentric cam 210 may be any suitable mechanism that may point drill bit 216, such as a cam, a sheave, or a disc. Thrust bearings 212 may be designed to absorb the force and torque generated by drill bit 216 while drill bit 216 is drilling a wellbore (e.g., wellbore 114 shown in FIG. 1A). The planetary gears may be connected to housing 206 and inner shaft 208 to maintain drill bit 216 at a desired toolface. To point and maintain drill bit 216 at a specified toolface, the toolface may be held in a geostationary position (e.g., the toolface remains at the same angle relative to a reference in the plane perpendicular to the drill string axis) based on the rotation of inner shaft 208 in an equal and opposite direction to the rotation of housing 206 with the drill string. While the toolface may be geostationary, drill bit 216 may rotate to drill a wellbore. For example, drill bit 216 may rotate in direction 222.

During drilling operations, housing 206 may not rotate at a constant speed due to disturbances acting on housing 206 or on drill bit 216. For example, during a stick-slip situation, drill bit 216 and housing 206 may rotate in a halting fashion where drill bit 216 and housing 206 stop rotating at certain times or rotate at varying speeds. As such, the rotational speed of inner shaft 208 may need to be adjusted during the drilling operation to counteract the effect of the disturbances acting on housing 206 and to maintain inner shaft 208 rotating equal and opposite of the rotation of housing 206. Failure to maintain inner shaft 208 rotating equal and opposite of the rotation of housing 206 may result in toolface error, a difference between the current toolface and the desired toolface at drill bit 216.

In some embodiments, rotary steerable drilling system 200 may include a control system 230. Control system 230 may adjust the flow of drilling fluid into turbine 204 in response disturbances acting on housing 206 or on drill bit 216 in order to minimize toolface error at drill bit 216. For example, control system 230 may be communicatively coupled to one or more sensors (e.g., gravitometer, accelerometer, magnetometer) (not expressly shown) along rotary steerable drilling system 200 that are capable of detecting disturbances acting on housing 206 or on drill bit 216. In response to detecting these disturbances, control system 230 may adjust the flow of drilling fluid into turbine 204 by opening or closing valve 202, thereby changing the rotational speed of inner shaft 208 by way of turbine 204, and ultimately, control system 230 may reduce toolface error at drill bit 216. Part, all, or none of the components comprising and interacting with control system 230 may be located within the wellbore.

In some embodiments, control system 230 may use pulse width modulation to adjust valve 202. Instead of, or in addition to, gradual analog control signals, control system 230 may use digital steps with pulse width modulation control signals as disclosed in greater detail with respect to FIGS. 3 and 4. Pulse width modulation may reduce toolface error at drill bit 216 by improving the response time of rotary steerable drilling system 200 to control signals from control system 230. Additionally, the digital steps used with pulse width modulation control signals may be implemented with Digital Signal Processing (DSP) micro controllers, which may allow for quick response times for detecting and responding to toolface error.

Even with control system 230 adjusting the flow of drilling fluid into turbine 204, a toolface error (e.g., a difference between the current toolface and the desired toolface) may still occur at drill bit 216. This toolface error may in part be caused by the delay from the time control system 230 issues a control signal to the time the rotational speed of turbine 204 changes in response to that signal. For example, control system 230 may issue a control signal to an actuator (not expressly shown) to adjust valve 202. The actuator may take time to open or close valve 202 after receiving the control signal from control system 230. After valve 202 opens or closes, changes in the flow rate of drilling fluid from valve 202, which may be located uphole from turbine 204, may take additional time to travel the distance of the drill string before reaching turbine 204. Delays from other components in the rotary steerable drilling system 200 may also add delay to the time it takes the rotational speed of turbine 204 to respond to a control signal from controller 230. Accordingly, inner shaft 208, which may be coupled to turbine 204, may also experience a delayed response to control system 230, resulting in a toolface error at drill bit 216. Because disturbances acting on housing 206 or on drill bit 216 may occur suddenly, faster responses in the rotational speed of turbine 204 may help reduce toolface error. Therefore, a control system capable of quicker adjustments to the rotational speed of turbine 204 may assist at reducing toolface error at drill bit 216.

In some embodiments, rotary steerable drilling system 200 may include a bypass controller 250. Bypass controller 250 may receive measurements from sensors along rotary steerable drilling system 200, including for example, turbine speed sensor 240 and cam speed sensor 242. With these measurements, bypass controller 250 may detect disparities in the rotational speed of inner shaft 208 and the rotational speed of outer housing 206 and/or drill bit 216. Disparities in these rotational speeds may represent a toolface error at drill bit 216. In addition to, or as an alternative to turbine speed sensor 240 and/or cam speed sensor 242, bypass controller 250 may receive measurements from any other sensor, including but not limited to accelerometers, gravitometers, and/or magnetometers (not expressly shown) associated with rotary steerable drilling system 200.

Bypass controller 250 may form a closed loop feedback system capable of responding to toolface error at drill bit 216. For example, in addition to receiving measurements from sensors (e.g., turbine speed sensor 240 and cam speed sensor 242) associated with rotary steerable drilling system 200, bypass controller 250 may also be coupled to bypass valve 260 located within bypass channel 262. Bypass controller 250 may be configured to divert drilling fluid flow away from turbine 204 which may affect the rotational speed of inner shaft 208, and thereby the toolface at drill bit 216. In some embodiments, bypass controller 250 may be configured to open and close bypass valve 260, thereby controlling the flow of fluid into bypass channel 262. For example, bypass controller 250 may be coupled to an actuator (not expressly shown) capable of opening and closing bypass valve 260. A current or voltage sent to the actuator may change the amount that bypass valve 260 is opened. In some embodiments, bypass controller 250 may adjust bypass valve 260 in response to detecting toolface error and/or disparities in the rotational speed of inner shaft 208 and the rotational speed of outer housing 206 and/or drill bit 216. Bypass valve 260 may be any type of valve capable of controlling the flow rate of drilling fluid into bypass channel 262, including those disclosed in more detail with respect to FIGS. 5A and 5B, and any others available in the drilling industry.

As an illustration, to decrease the rotational speed of turbine 204, bypass controller 250 may issue a control signal to an actuator (not expressly shown). In response to the control signal, the actuator may open bypass valve 260 by a fractional amount so that the flow rate of drilling fluid into bypass channel 262 increases. Increasing the flow rate of drilling fluid into bypass channel 262 may cause a proportional decrease in the amount of drilling fluid entering turbine 204. In response to the decreased drilling fluid entering turbine 204, the rotational speed of turbine 204, and thus inner shaft 208, may slow. Similarly, bypass controller 250 may increase the rotational speed of turbine 204 by closing valve 260, causing less drilling fluid to flow into bypass channel 262 and more drilling fluid to enter turbine 204.

To effectuate change in the flow rate of drilling fluid into turbine 204 as quickly as possible, bypass channel 262 and bypass valve 260 may be placed in close proximity to turbine 204. Placing bypass channel 262 and bypass valve 260 near turbine 204 may decrease delays associated with the drilling fluid traveling the length of the drill string to reach turbine 204. Drilling fluid flowing into bypass channel 262 may be directed downhole to the drill bit, such as drill bit 101 shown in FIG. 1A. Any such bypassed drilling fluid may be circulated uphole to well surface 106 through annulus 108.

To determine the optimal control signal, bypass controller 250 may store and process inputs received at the controller. In some embodiments, bypass controller 250 may contain and/or connect to a computer that acts as a data acquisition system and/or processing system for inputs to bypass controller 250. Bypass controller 250 may contain a central processing unit and memory with software to determine an optimal control signal based on inputs to bypass controller 250. Further, bypass controller 250 may also include a proportional-integral-derivative (PID) system that uses the proportion (e.g., the current toolface error), the derivative (e.g., the change in the toolface error), and/or the integral (e.g., the average of past toolface error) of input data to determine a control signal with which to adjust bypass valve 260. Part, all, or none of the components comprising bypass controller 250 may be located within the wellbore.

Bypass controller 250 may use pulse width modulation to open and close bypass valve 260. Instead of, or in addition to, gradual analog control signals, bypass controller 250 may use digital steps with pulse width modulation control signals, as disclosed above with respect to control system 230.

Figure 3:
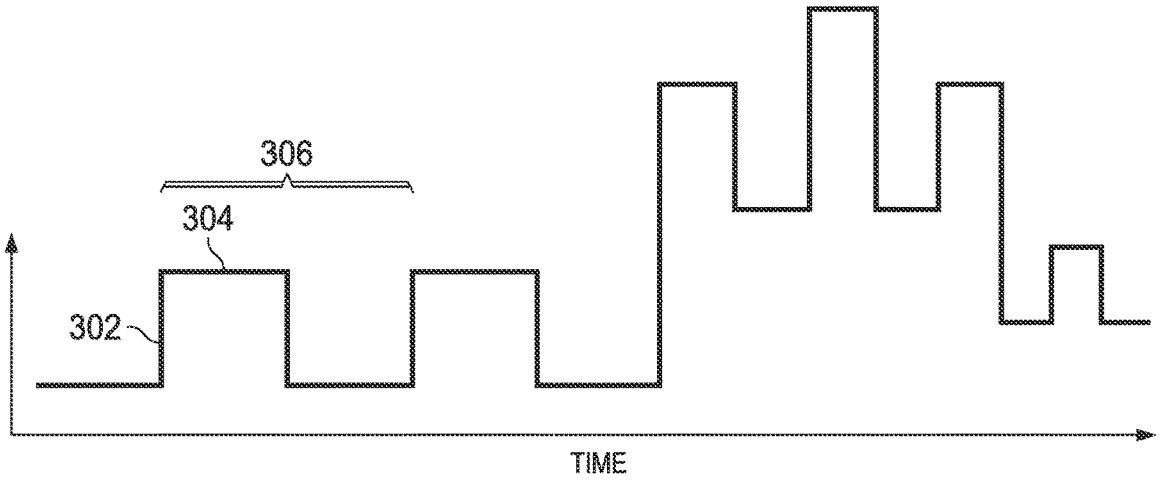
FIG. 3 illustrates a graph of an exemplary control signal with pulse width modulation.

FIG. 3 illustrates a graph of an exemplary control signal with pulse width modulation. Amplitude 302 of the control signal may correspond to the magnitude of the signal. For example, amplitude 302 may represent the magnitude or amount of voltage or current applied to an actuator adjusting a valve opening. A higher amplitude 302 may represent a higher voltage or current to the actuator adjusting the valve opening, thereby affecting the amount the valve opens and/or the speed at which the valve opens. The valve opening may in turn affect, for example, the flow rate of drilling fluid passing through the valve. Duration 304 may represent an amount of time the control signal remains at a particular amplitude 302. For example, duration 304 may reflect the amount of time a valve remains open, and increasing duration 304 may cause drilling fluid to flow for a longer period of time through the valve. Duty 306 may represent a total time between the pulses of the control signal. For example, duty 306 may represent the total time between periodic openings and/or closings of the valve. Therefore, a controller may vary amplitude 302, duration 304, and/or duty 306 of the control signal with pulse width modulation. For example, the digital steps representing the control signal may vary widely, as shown in FIG. 3. In some embodiments, a controller may use pulse width modulation to control the rotational speed of elements within a rotary steerable drilling system. For example, the controller may use pulse width modulation to control the rotational speed of turbine 204 as disclosed with respect to FIG. 2.

Figure 4:
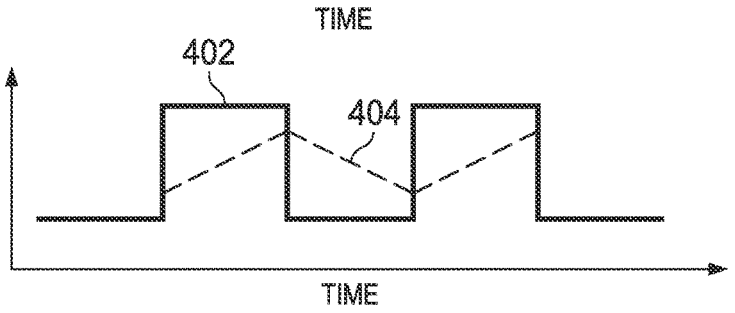
FIG. 4 illustrates a graph of an exemplary control signal with pulse width modulation with an exemplary valve response to the control signal.

Despite the ideal digital step function illustrated in the control signal of FIG. 3, the element receiving the control signal may not be able to respond as quickly as the control signal requests. For example, a valve receiving a control signal may not be able to open and close as quickly as the controller requests. FIG. 4 illustrates a graph of an exemplary control signal with pulse width modulation with an exemplary valve response to the control signal. The valve receiving control signal 402 may experience delay opening and closing because of non-ideal components within the control system, including but not limited to the actuator opening and closing the valve, the power source supplying power to the actuator, and/or the valve itself. Any of these components may cause delay in response 404 to control signal 402. The disparity between control signal 402 and response 404 may assist in selecting the appropriate amplitude, duration, and duty of the control signal used by the controller.

The valves used to control the flow rate of drilling fluid may be selected at least in part based on the speed with which the valve opens and closes. The speed of the valve may affect the ability of the rotary steerable drilling system to react to disturbances at the housing or drill bit caused by vibrations, bit walk, bit bounce, the presence of formation cuttings, or any other cause of a tool rotation anomaly. Therefore, the response speed of the valve may be important to reducing and managing toolface error at the drill bit. Other considerations in selecting the valve may include, for example, the durability, capacity, precision, cost, or maintenance of the valve, and/or the power required to open and close the valve.

Figure 5A:
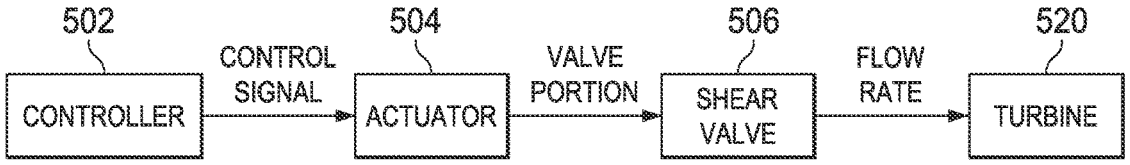
FIG. 5A illustrates a system model that describes the behavior of a rotary steerable drilling system with a sheer valve.
Figure 5B:
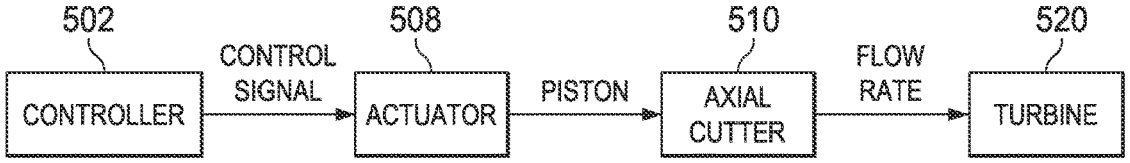
FIG. 5B illustrates a system model that describes the behavior of a rotary steerable drilling system with an axial cutter.

FIG. 5A illustrates a system model that describes the behavior of a rotary steerable drilling system with a sheer valve. Shear valve 506 may be used to adjust the flow rate of drilling fluid into turbine 520. Controller 502 may issue a control signal to actuator 504, which may adjust the valve position of shear valve 506, which may in turn affect the flow rate of drilling fluid into turbine 520. FIG. 5B illustrates a system model that describes the behavior of a rotary steerable drilling system with an axial cutter. Controller 502 may issue control signal to actuator 508, which may adjust a piston controlling axial cutter 510, which may in turn affect the flow rate of drilling fluid into turbine 520. The time it takes to change the flow rate of drilling fluid at turbine 520 in FIGS. 5A and 5B may depend on the speed with which actuator 504 and actuator 508 open and close each respective valve. For example, actuator 504 may include a motor powered by an electric power supply that opens and closes shear valve 506. Actuator 508 by contrast, may include a hydraulic or pneumatic supply that moves a piston in axial cutter 508. In certain conditions, axial cutter 510 may be capable of adjusting the flow rate of drilling fluid into turbine 520 quicker than shear valve 506. A quicker change in the flow rate of drilling fluid into turbine 520 may reduce the response time of the rotary steerable drilling system, and thereby the toolface error at the drill bit. In some embodiments, valve 202 and bypass valve 260 disclosed with respect to FIG. 2 may represent shear valve 506, axial cutter 510, or any other device (e.g., magnetic, electro-magnetic, pneumatic, and/or hydraulic actuated valves) capable of regulating the flow rate of drilling fluid.

Embodiments disclosed herein include:

A. A drilling system including a rotating drill string of a drilling tool, an assembly located within the rotating drill string representing a current toolface of the drilling tool, and a controller configured to use pulse width modulation to adjust a rotational speed of the assembly to maintain the current toolface at a desired toolface.

B. A method of forming a wellbore including determining a desired toolface of a rotating drilling tool, calculating a toolface error by determining a distance between a current toolface and the desired toolface of the rotating drilling tool, using a pulse width modulation to control the rotational speed of an assembly located within the rotating drilling tool to minimize the toolface error, and drilling a wellbore with a drill bit coupled to the rotating drilling tool.

Each of the embodiments A and B may have one or more of the following additional elements in any combination: Element 1: wherein the controller is located within the wellbore. Element 2: wherein the controller is configured to adjust a flow of fluid across a turbine that powers a rotation of the assembly. Element 3: wherein the controller is configured to adjust the flow of fluid across the turbine by diverting a portion of the flow of fluid to a bypass channel. Element 4: wherein the controller is configured to adjust the portion of the flow of fluid to the bypass channel by adjusting a valve within the bypass channel. Element 5: wherein the valve is a shear valve. Element 6: wherein the valve is an axial cutter. Element 6: further comprising a sensor coupled to the assembly, wherein the controller is further configured to use a measurement from the sensor to determine the current toolface. Element 7: wherein the pulse width modulation represents a variation in at least one of an amplitude, a duration, and a duty of a control signal.

Although the present disclosure has been described with several embodiments, various changes and modifications may be suggested to one skilled in the art. For example, although the present disclosure describes controlling the rotational speed of an inner shaft within a rotary steerable drilling system, the same principles disclosed herein may be applied to control the rotation of any element within a drilling system. Further, although the embodiments disclosed herein describe a turbine powered by the flow of drilling fluid, the same principles disclosed herein may be applied to an element powered by any other manner. For example, the pulse width modulation principles described herein may be used in combination with an element whose rotation is controlled and/or powered by electric, magnetic, electro-magnetic, pneumatic, and/or hydraulic power without the use of valves and/or drilling fluid. It is intended that the present disclosure encompasses such changes and modifications as fall within the scope of the appended claims.

What is claimed is:

1. A drilling system comprising:

a rotating drill string of a drilling tool;

an assembly located within the rotating drill string representing a current toolface of the drilling tool, the assembly rotating opposite the rotating drill string during a drilling operation; and a controller configured to use pulse width modulation to control a flow of fluid across a turbine, the turbine adjusting a rotational speed of the assembly to be approximately equal and opposite the rotating drill string in order to maintain the current toolface at a desired toolface.

2. The drilling system according to claim 1, wherein the controller is located within the wellbore.

3. The drilling system according to claim 1, wherein the controller is configured to adjust the flow of fluid across the turbine by diverting a portion of the flow of fluid to a bypass channel.

4. The drilling system according to claim 3, wherein the controller is configured to adjust the portion of the flow of fluid to the bypass channel by adjusting a valve within the bypass channel.

5. The drilling system according to claim 4, wherein the valve is a shear valve.

6. The drilling system according to claim 4, wherein the valve is an axial cutter.

7. The drilling system according to claim 1, further comprising a sensor coupled to the assembly, wherein the controller is further configured to use a measurement from the sensor to determine the current toolface.

8. The drilling system according to claim 1, wherein the pulse width modulation represents a variation in at least one of an amplitude, a duration, and a duty of a control signal.

9. A method of forming a wellbore comprising:

determining a desired toolface of a rotating drilling tool;

calculating a toolface error by determining a distance between a current toolface and the desired toolface of the rotating drilling tool;

rotating an assembly located within a rotating drill string of the rotating drilling tool opposite the rotating drill string, the assembly representing the current toolface of the rotating drilling tool;

using a pulse width modulation to control a flow of fluid across a turbine, the turbine adjusting the rotational speed of the assembly to be approximately equal and opposite the rotating drill string to minimize the toolface error; and drilling a wellbore with a drill bit coupled to the rotating drilling tool.

10. The method of claim 9, wherein the pulse width modulation occurs within the wellbore.

11. The method of claim 9, wherein the pulse width modulation adjusts the flow of fluid into the turbine by diverting a portion of the flow of fluid into a bypass channel.

12. The method of claim 11, wherein the pulse width modulation controls the flow of fluid into the bypass channel by adjusting a valve within the bypass channel.

13. The method of claim 12, wherein the valve is a shear valve.

14. The method of claim 12, wherein the valve is an axial cutter.

15. The method of claim 9, wherein the current toolface of the rotating drilling tool is determined by a measurement from a sensor coupled to the rotating drilling tool.

16. The method of claim 9, wherein the pulse width modulation represents a variation in at least one of an amplitude, a duration, and a duty of a control signal.

* * * * *